US010704517B2

(12) United States Patent
Wilson et al.

(10) Patent No.: US 10,704,517 B2
(45) Date of Patent: Jul. 7, 2020

(54) COMBUSTION CHAMBER AND A COMBUSTION CHAMBER FUEL INJECTOR SEAL

(71) Applicant: ROLLS-ROYCE plc, London (GB)

(72) Inventors: David P. Wilson, Derby (GB); John E. Rimmer, Loughborough (GB); Jochen Rupp, Burton-upon-Trent (GB); Damian Martin, Derby (GB); Emmanuel V. Aurifeille, Derby (GB); Kyriakoulis L. Resvanis, Derby (GB); Michael J. Allitt, Derby (GB)

(73) Assignee: ROLLS-ROYCE PLC, London (GB)

( * ) Notice: Subject to any disclaimer, the term of this patent is extended or adjusted under 35 U.S.C. 154(b) by 319 days.

(21) Appl. No.: 15/837,446

(22) Filed: Dec. 11, 2017

(65) Prior Publication Data

US 2018/0171953 A1 Jun. 21, 2018

(30) Foreign Application Priority Data

Dec. 20, 2016 (GR) ..... 20160100637

(51) Int. Cl.
*F02M 61/14* (2006.01)
*F23R 3/28* (2006.01)
(Continued)

(52) U.S. Cl.
CPC ..... *F02M 61/14* (2013.01); *F23R 3/002* (2013.01); *F23R 3/283* (2013.01); *F23R 3/50* (2013.01);
(Continued)

(58) Field of Classification Search
CPC ..... F23R 3/283; F23R 3/286; F23R 2900/00012; F23R 2900/03044;
(Continued)

(56) References Cited

U.S. PATENT DOCUMENTS 3,453,826 A * 7/1969 Hering ..... F23C 7/00 60/740
4,322,945 A 4/1982 Peterson et al.
(Continued)

FOREIGN PATENT DOCUMENTS

EP 0841520 5/1998
GB 2511563 3/2013
(Continued)

OTHER PUBLICATIONS

European Search Report dated Apr. 11, 2018, issued in EP Patent Application No. 17203265.
(Continued)

*Primary Examiner* — Alain Chau
(74) *Attorney, Agent, or Firm* — Oliff PLC

(57) ABSTRACT

A combustion chamber comprising an upstream end wall, at least one annular wall, at least one fuel injector and at least one seal. The at least one annular wall being secured to the upstream end wall. The upstream end wall having at least one aperture. Each fuel injector being arranged in a corresponding one of the apertures in the upstream end wall and each seal being arranged in a corresponding one of the apertures in the upstream end wall and around the corresponding one of the fuel injectors. Each seal having an inner surface facing the corresponding one of the fuel injectors and an outer surface facing away from the corresponding one of the fuel injectors. Each seal abutting the corresponding one of the fuel injectors. The downstream end of each seal increasing in diameter in a downstream direction and the upstream end of each seal having a radially extending flange. Each seal having a plurality of coolant apertures extending axially through the radially extending flange and/or each seal having a plurality of thermal conductors
(Continued)

extending axially from the radially extending flange to the downstream end of the seal.

23 Claims, 9 Drawing Sheets

(51) Int. Cl.
*F23R 3/00* (2006.01)
*F23R 3/50* (2006.01)

(52) U.S. Cl.
CPC .... *F02B 2275/14* (2013.01); *F02M 2200/858* (2013.01); *F05D 2260/22141* (2013.01); *F23R 2900/00012* (2013.01); *F23R 2900/03044* (2013.01)

(58) Field of Classification Search
CPC ..... F23R 2900/03041–03044; F23R 3/002; F23R 3/50; F05D 2260/2241; F02M 2200/585; F02M 2200/85; F02M 2200/858; F02M 61/14; F05B 2260/2241; F05B 2275/14
See application file for complete search history.

(56) References Cited

U.S. PATENT DOCUMENTS 4,365,470 A 12/1982 Matthews et al.
4,686,823 A * 8/1987 Coburn ..... F23R 3/283 60/740
4,870,818 A * 10/1989 Suliga ..... F23R 3/283 60/740
4,914,918 A * 4/1990 Sullivan ..... F23D 11/36 60/756
4,934,145 A * 6/1990 Zeisser ..... F23R 3/002 60/740
5,253,471 A * 10/1993 Richardson ..... F23R 3/10 60/754
5,419,115 A * 5/1995 Butler ..... F23R 3/10 60/740
5,894,732 A 4/1999 Kwan
5,956,955 A * 9/1999 Schmid ..... F23R 3/283 60/748
5,974,805 A 11/1999 Allen
6,032,457 A 3/2000 McKinney et al.
7,640,752 B2 * 1/2010 Gautier ..... F02C 3/14 60/39.827
7,861,530 B2 1/2011 Hawie et al.
8,677,757 B2 * 3/2014 Sadig ..... F23R 3/04 60/752
8,701,417 B2 4/2014 Nicholls et al.
8,726,631 B2 * 5/2014 Rudrapatna ..... F02C 7/264 60/39.821
9,097,130 B2 * 8/2015 Willis ..... F01D 11/005
9,267,688 B2 2/2016 Milburn
9,562,474 B2 * 2/2017 Garry ..... B22D 25/02
9,587,831 B2 * 3/2017 Jause ..... F02C 7/20
9,625,156 B2 * 4/2017 Rudrapatna ..... F23R 3/14
10,018,167 B2 * 7/2018 Tentorio ..... F23D 11/383
2002/0038549 A1 4/2002 Ebel
2004/0011058 A1 1/2004 Baudoin et al.
2006/0272335 A1 12/2006 Schumacher et al.
2007/0227147 A1 10/2007 Cayre et al.
2008/0236169 A1 * 10/2008 Hawie ..... F23R 3/002 60/779
2011/0005233 A1 * 1/2011 Sadig ..... F23M 20/005 60/754
2012/0240583 A1 9/2012 Penz et al.
2012/0272652 A1 * 11/2012 Nicholls ..... F23R 3/10 60/740
2012/0272661 A1 * 11/2012 Milburn ..... F23R 3/10 60/796
2013/0055722 A1 3/2013 Verhiel et al.
2013/0199194 A1 8/2013 Carlisle
2014/0069103 A1 * 3/2014 Willis ..... F01D 11/005 60/740
2014/0144148 A1 * 5/2014 Jause ..... F02C 7/28 60/772
2014/0250917 A1 9/2014 Garry
2014/0318148 A1 10/2014 Clemen et al.
2015/0040575 A1 2/2015 Martinez Fabre et al.
2015/0113993 A1 * 4/2015 Rudrapatna ..... B22F 5/009 60/748
2015/0135716 A1 * 5/2015 Ginessin ..... F23R 3/28 60/737
2015/0135720 A1 5/2015 Papple et al.
2016/0025008 A1 1/2016 Garry et al.
2016/0169178 A1 * 6/2016 Tentorio ..... F02M 61/162 60/748
2016/0169522 A1 6/2016 Cunha et al.

FOREIGN PATENT DOCUMENTS

WO 2015089278 6/2015
WO 2016051067 4/2016

OTHER PUBLICATIONS

Great Britain Search Report dated Jul. 24, 2017, issued in GB Patent Application No. 1701380.6.

* cited by examiner

COMBUSTION CHAMBER AND A COMBUSTION CHAMBER FUEL INJECTOR SEAL

CROSS-REFERENCE TO RELATED APPLICATION

This application is based upon and claims the benefit of priority from Greek Patent Application Number 20160100637 filed 20 Dec. 2016, the entire contents of which are incorporated by reference.

FIELD OF DISCLOSURE

The present disclosure relates to a combustion chamber and in particular to a gas turbine engine combustion chamber and also relates to a combustion chamber fuel injector seal and in particular to a gas turbine engine combustion chamber fuel injector seal.

BACKGROUND

A combustion chamber comprises an upstream end wall, at least one annular wall, at least one fuel injector and at least one seal. The annular wall is secured to the upstream end wall and the upstream end wall has at least one aperture. Each fuel injector is arranged in a corresponding one of the apertures in the upstream end wall. Each seal is arranged in a corresponding one of the apertures in the upstream end wall and around the corresponding one of the fuel injectors. Each seal has a first portion, a second portion and a third portion. The second portion of each seal abuts the corresponding one of the fuel injectors. The third portion of each seal is arranged at the downstream end of the seal and the third portion increases in diameter in a downstream direction. The first portion of each seal is arranged upstream of the second portion and the first portion has a plurality of coolant apertures extending there-through.

The coolant apertures in the first portion of each seal direct the coolant there-through with axial and radial velocity components towards the third portion of the seal. The coolant impinges on the upstream surface, or cold surface, of the third portion of the seal to provide impingement cooling.

However, it has been realised that the impingement cooling of the upstream surface, or cold surface, of the third portion of the seal is not completely effective in reducing the temperature of the third portion of the seal sufficiently to prevent melting and melting back of the third portion of the seal. Melting of the third portion of the seal leads to material release and the realised material is deposited onto the annular wall of the combustion chamber, e.g. combustion chamber tiles, and other components of the gas turbine engine, e.g. turbine blades and turbine vanes, downstream of the combustion chamber. The deposition of molten material can lead to the blocking of cooling holes in the annular wall of the combustion chamber, e.g. the combustion chamber tiles, or blocking of cooling holes of components downstream of the combustion chamber. The blocking of the cooling holes in the annular wall of the combustion chamber, e.g. combustion chamber tiles, and other components downstream of the combustion chamber increases the temperature of these components and thereby reduces their working life. Furthermore, melting of the third portion of the seal also leads to a change in local mixing and stoichiometry in the combustion chamber resulting in an increase in the temperature of surrounding combustion chamber components, e.g. the combustion chamber heat shield and the burner seal locating rings. The increase of temperature of the surrounding combustion chamber components reduces the working life of these surrounding combustion chamber components.

The present disclosure seeks to produce a combustion chamber and a combustion chamber fuel injector seal which reduces, or overcomes, the above mentioned problem.

BRIEF SUMMARY

According to a first aspect of the present disclosure there is provided a combustion chamber comprising an upstream end wall, at least one annular wall, at least one fuel injector and at least one seal, the at least one annular wall being secured to the upstream end wall, the upstream end wall having at least one aperture, each fuel injector being arranged in a corresponding one of the apertures in the upstream end wall, each seal being arranged in a corresponding one of the apertures in the upstream end wall and around the corresponding one of the fuel injectors, each seal having an inner surface facing the corresponding one of the fuel injectors and an outer surface facing away from the corresponding one of the fuel injectors, each seal abutting the corresponding one of the fuel injectors, the downstream end of each seal increasing in diameter in a downstream direction, the upstream end of each seal having a radially extending flange, each seal having a plurality of coolant apertures extending axially through the radially extending flange and/or each seal having a plurality of thermal conductors extending axially from the radially extending flange to the downstream end of the seal.

Each seal may have at least one row of circumferentially spaced apertures extending axially through the radially extending flange. Each seal may have a plurality of rows of circumferentially spaced apertures extending axially through the radially extending flange The diameter of the coolant apertures may be less than or equal to 3 mm and more than or equal to 0.4 mm.

The axes of the coolant apertures may be angled radially inwardly or angled radially outwardly. The coolant apertures may be angled radially inwardly at an angle of less than or equal to 60°. The coolant apertures may be angled radially inwardly at an angle of less than or equal to 45°. The coolant apertures may be angled radially inwardly at an angle of less than or equal to 30°. The coolant apertures may be angled radially outwardly at an angle of less than or equal to 60°. The coolant apertures may be angled radially outwardly at an angle of less than or equal to 45°. The coolant apertures may be angled radially outwardly at an angle of less than or equal to 30°. The coolant apertures may extend purely perpendicularly through the radially extending flange.

The axes of the coolant apertures may be angled circumferentially. The coolant apertures may be angled circumferentially in the direction of the swirling fuel and air mixture from the fuel injector. The coolant apertures may be angled circumferentially at an angle of less than or equal to 60°. The coolant apertures may be angled circumferentially at an angle of less than or equal to 45°. The coolant apertures may be angled circumferentially at an angle of less than or equal to 30°. The coolant apertures may be angled circumferentially in the opposite direction of the swirling fuel and air mixture from the fuel injector. The coolant apertures may be angled circumferentially at an angle of less than or equal to 10°.

The coolant apertures in the radially extending flange may be arranged at a radius less than or equal to the radius of the outer surface of the seal+(0.6×(radius of the aperture in the upstream end wall−radius of the outer surface of the seal))

and at a radius more than or equal to the radius of the outer surface of the seal+(0.3×(radius of the aperture in the upstream end wall−radius of the outer surface of the seal)).

Each seal may have a plurality of circumferentially spaced thermal conductors extending axially from the radially extending flange to the downstream end of the seal.

Each thermal conductor may extend radially outwardly from the outer surface of the seal.

Each thermal conductor may extend radially outwardly from the outer surface of the seal throughout the full axial distance between the radially extending flange and the downstream end of the seal.

The thermal conductors may be ribs.

The thermal conductors may be hollow.

Each thermal conductor may be rectangular in cross-section.

Each thermal conductor may have a radially outer surface remote from the outer surface of the seal and side surfaces extending radially from the radially outer surface to the outer surface of the seal.

The surface area of the radially outer surface of the thermal conductor divided by twice the surface area of the side surfaces of the thermal conductor may be less than 1.

There may be between 1 and 10 coolant apertures extending axially through the radially extending flange positioned between each pair of circumferentially spaced thermal conductors. The diameter of the coolant apertures may be less than or equal to 3 mm and more than or equal to 0.4 mm.

There may be between 1 and 10 coolant apertures extending through the seal from the inner surface to the outer surface positioned between each pair of circumferentially spaced thermal conductors. The diameter of the coolant apertures may be less than or equal to 3 mm and more than or equal to 0.4 mm.

Each seal may be manufactured by additive layer manufacturing.

The downstream end of each seal may be positioned axially downstream of the upstream end wall. The upstream end of each seal may be positioned axially upstream of the upstream end wall. The radially extending flange of each seal may be positioned axially upstream of the upstream end wall.

A heat shield may be positioned downstream of the upstream end wall. The downstream end of each seal may be positioned axially downstream of the heat shield. The radially extending flange of each seal may be positioned axially between the upstream end wall and the heat shield. The radially extending flange of each seal may be positioned axially upstream of the upstream end wall.

Each seal may be located in the corresponding one of the apertures in the upstream end wall such that an annular space is formed between the outer surface of the seal and the upstream end wall.

The fuel injector may be a rich burn fuel injector or a lean burn fuel injector.

The combustion chamber may be a gas turbine engine combustion chamber.

The gas turbine engine may be an industrial gas turbine engine, an automotive gas turbine engine, a marine gas turbine engine or an aero gas turbine engine.

The aero gas turbine engine may be a turbofan gas turbine engine, a turbojet gas turbine engine, a turbo-propeller gas turbine engine or a turbo-shaft gas turbine engine.

According to a second aspect of the present disclosure there is provided a combustion chamber seal having an inner surface arranged in operation to face a fuel injector and an outer surface arranged in operation to face away from a fuel injector, the downstream end of the seal increasing in diameter in a downstream direction, the upstream end of the seal having a radially extending flange, the seal having a plurality of coolant apertures extending axially through the radially extending flange and/or the seal having a plurality of thermal conductors extending axially from the radially extending flange to the downstream end of the seal.

BRIEF DESCRIPTION OF DRAWINGS

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

DETAILED DESCRIPTION

Figure 1:
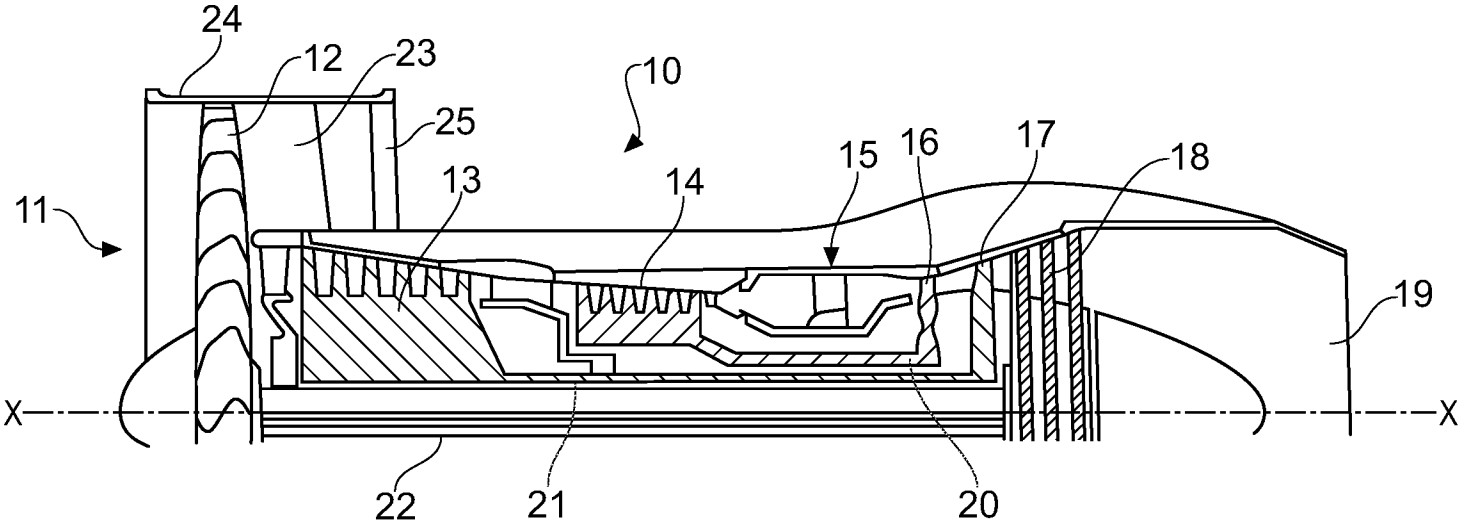
FIG. 1 is a sectional side view of a gas turbine engine having a combustion chamber according to the present disclosure.

With reference to FIG. 1, a gas turbine engine is generally indicated at 10, having a principal and rotational axis X-X.

The engine 10 comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and an exhaust nozzle 19. A fan nacelle 24 generally surrounds the fan 12 and defines the intake 11 and a fan duct 23. The fan nacelle 24 is secured to the core engine by fan outlet guide vanes 25.

The gas turbine engine 10 works in the conventional manner so that air entering the intake 11 is compressed by the fan 12 to produce two air flows: a first air flow into the intermediate pressure compressor 13 and a second air flow which passes through the bypass duct 23 to provide propulsive thrust. The intermediate pressure compressor 13 compresses the air flow directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high 16, intermediate 17 and low 18 pressure turbines drive respectively the high pressure compressor 14, the intermediate pressure compressor 13 and the fan 12, each by suitable interconnecting shaft 20, 21 and 22 respectively.

Figure 2:
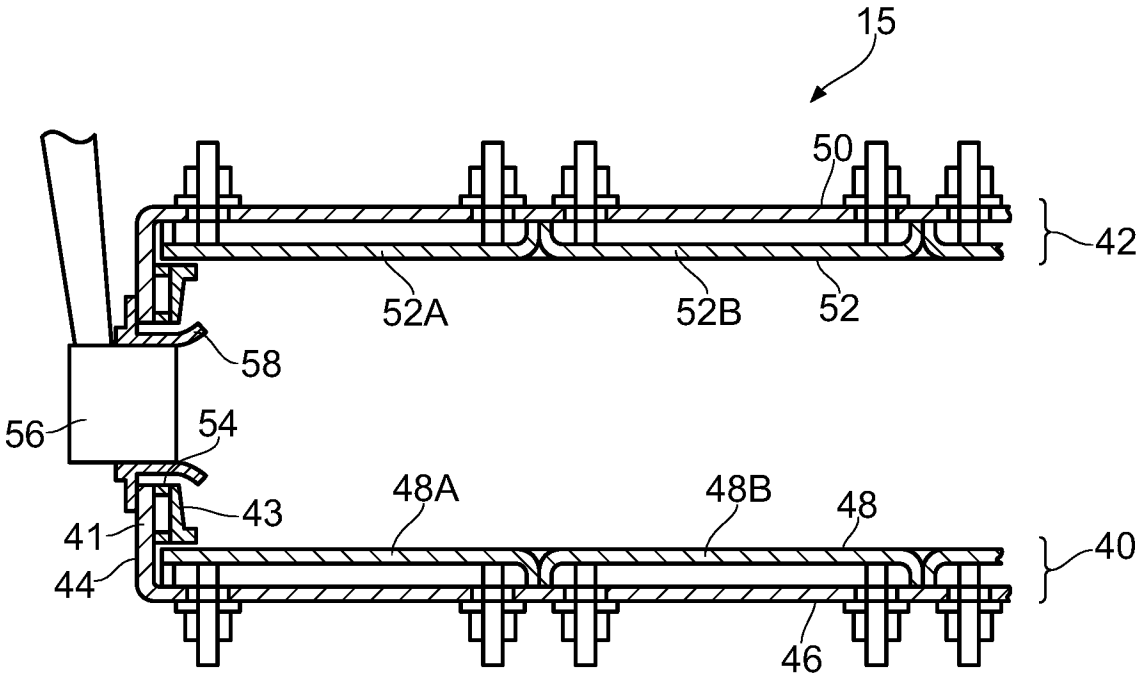
FIG. 2 is an enlarged cross-sectional view through a combustion chamber according to the present disclosure.
Figure 4:
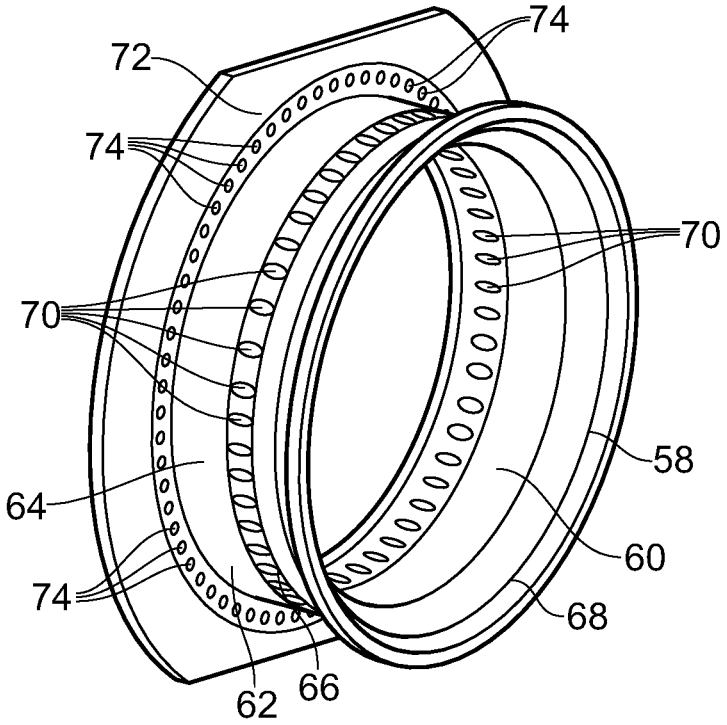
FIG. 4 is a perspective view of a combustion chamber fuel injector seal shown in FIG. 3.
Figure 3:
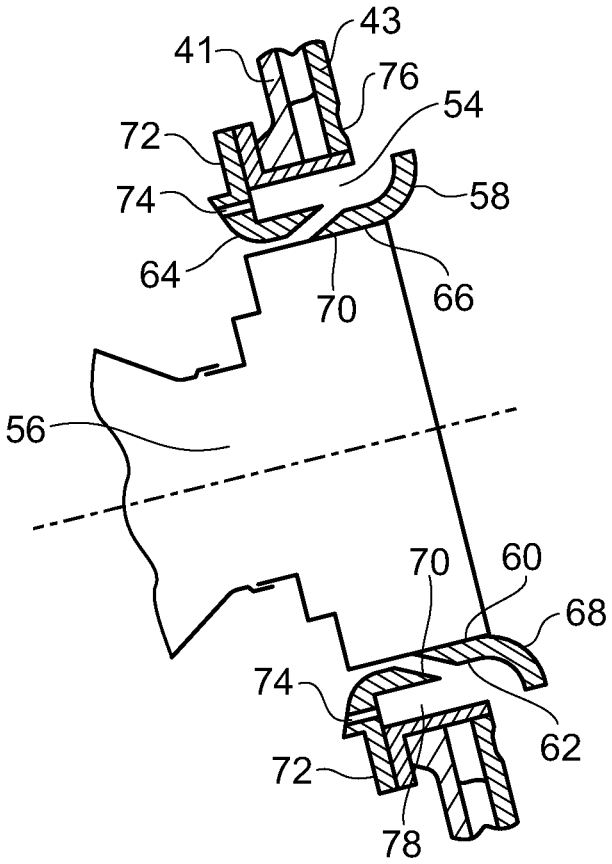
FIG. 3 is a further enlarged cross-sectional view through a combustion chamber fuel injector seal according to the present disclosure.
Figure 5:
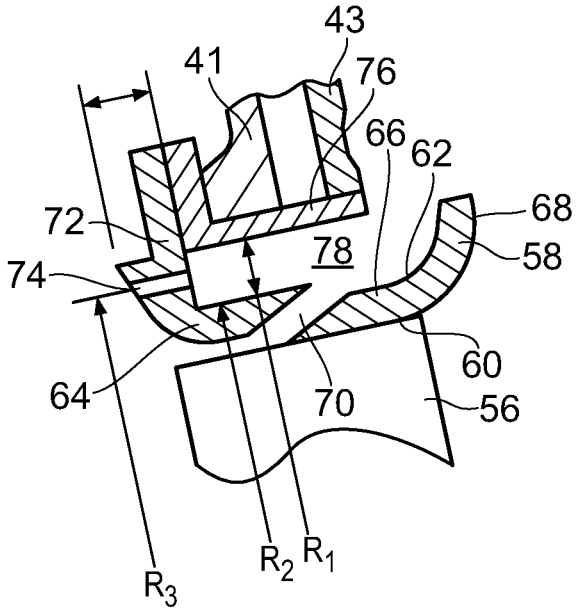
FIG. 5 is a further enlarged cross-sectional view of a portion of the combustion chamber fuel injector seal shown in FIG. 3.
Figure 7:
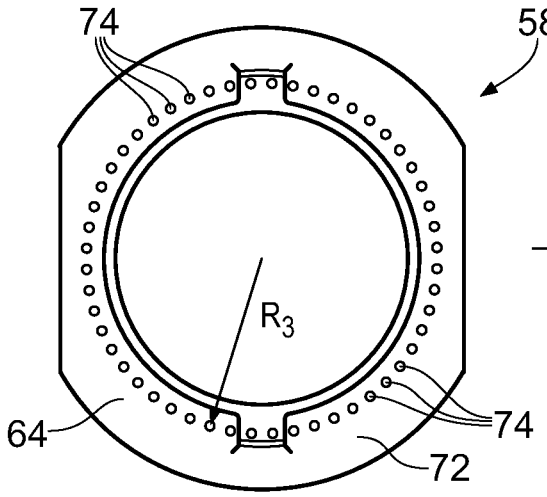
FIG. 7 is a view in the direction of arrow A in FIG. 6.
Figure 6:
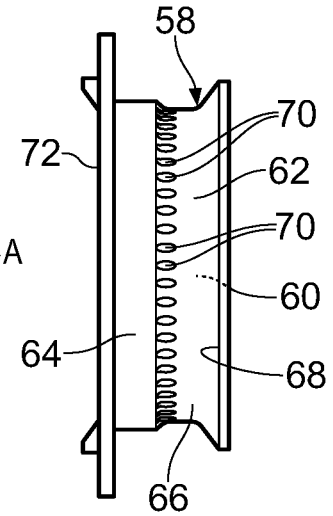
FIG. 6 is a plan view of a combustion chamber fuel injector seal according to the present disclosure.

The combustion chamber 15, as shown more clearly in FIG. 2, is an annular combustion chamber and comprises a radially inner annular wall structure 40, a radially outer annular wall structure 42 and an upstream end wall structure 44. The radially inner annular wall structure 40 comprises a first annular wall 46 and a second annular wall 48. The radially outer annular wall structure 42 comprises a third annular wall 50 and a fourth annular wall 52. The second annular wall 48 is spaced radially from and is arranged radially around the first annular wall 46 and the first annular wall 46 supports the second annular wall 48. The fourth annular wall 52 is spaced radially from and is arranged radially within the third annular wall 50 and the third annular wall 50 supports the fourth annular wall 52. The upstream end wall structure 44 comprises an upstream end wall 41 and a plurality of heat shields 43. The heat shields 43 are spaced axially from and are arranged axially downstream of the upstream end wall 41 and the upstream end wall 41 supports the heat shields 43. The upstream end of the first annular wall 46 is secured to the upstream end wall 41 of the upstream end wall structure 44 and the upstream end of the third annular wall 50 is secured to the upstream end wall 41 of the upstream end wall structure 44. The upstream end wall structure 44 has a plurality of circumferentially spaced apertures 54 and each aperture 54 extends through the upstream end wall 41 and a respective one of the heat shield 43. The combustion chamber 15 also comprises a plurality of fuel injectors 56 and a plurality of seals 58. Each fuel injector 56 is arranged in a corresponding one of the apertures 54 in the upstream end wall structure 44 and each seal 58 is arranged in a corresponding one of the apertures 54 in the upstream end wall structure 44 and each seal 58 is arranged around, e.g. surrounds, the corresponding one of the fuel injectors 56. The fuel injectors 56 are arranged to supply fuel into the annular combustion chamber 15 during operation of the gas turbine engine 10. The second annular wall 48 comprises a plurality of rows of combustion chamber tiles 48A and 48B and the fourth annular wall 52 comprises a plurality of rows of combustion chamber tiles 52A and 52B. The combustion chamber tiles 48A and 48B are secured onto the first annular wall 46 by threaded studs, washers and nuts and the combustion chamber tiles 52A and 52B are secured onto the third annular wall 50 by threaded studs, washers and nuts. The heat shields 43 are secured onto the upstream end wall 41 by threaded studs, washers and nuts. The heat shields 43 are arranged circumferentially side by side in a row.

FIGS. 3 to 8 show one of the seals 58 in more detail. Each seal 58 has an inner surface 60 facing the corresponding one of the fuel injectors 56 and an outer surface 62 facing away from the corresponding one of the fuel injectors 56. Each seal 58 abuts the corresponding one of the fuel injectors 56. The downstream end of each seal 58 increases in diameter in a downstream direction. The upstream end of each seal 58 has a radially extending flange. Each seal has a first, upstream, portion 64, a second central, portion 66 and a third, downstream, portion 68. The second portion 66 abuts the corresponding one of the fuel injectors 56. The third portion 68 increases in diameter in a downstream direction. The first portion 64 is arranged upstream of the second portion 66 and the third portion 68 is arranged downstream of the second portion 64. The first portion 64 has a plurality of first coolant apertures 70 extending there-through and the first coolant apertures 70 extending through the first portion 64 with axial and radial components. The first coolant apertures 70 extend from the inner surface 60 to the outer surface of the seal 58. Each seal 58 has at least one row of circumferentially spaced first coolant apertures 70. The axes of the first coolant apertures 70 in first portion 64 of each seal 58 are arranged to intersect the third portion 68 of the seal 58 to direct coolant onto the third portion 68 of the seal 58 to provide impingement cooling. Each first coolant aperture 70 has an inlet in the inner surface 60 and an outlet in the outer surface 62 of the seal 58. The first coolant apertures 60 are arranged upstream of the third, downstream, portion of the seal 58. The outlet of each first coolant aperture 70 is axially spaced in a downstream direction from its inlet and the outlet of each coolant aperture 70 is radially spaced from its inlet.

Each seal 58 is generally circular in cross-section and each seal comprise a substantially cylindrical first portion 64, a substantially cylindrical second portion 66 and a frustoconical third portion 68 or a bell mouth third portion 68. The first portion 64 of each seal 58 has an inner diameter greater than the inner diameter of the second portion 66 of that seal 58. The inner surface 60 is a radially inner surface and the outer surface 62 is a radially outer surface.

The first portion 64 of each seal 58 has a radially extending flange 72 and each seal 58 has a plurality of second coolant apertures 74 extending axially through the radially extending flange 72. Each seal 58 has at least one row of circumferentially spaced second coolant apertures 74 extending axially through the radially extending flange 72. Each seal 58 may have a plurality of rows of circumferentially spaced second coolant apertures 74 extending axially through the radially extending flange 72. The diameter of the second coolant apertures 74 is less than or equal to 3 mm and more than or equal to 0.4 mm. In FIGS. 3 to 8 the second coolant apertures 74 extend purely perpendicularly through the radially extending flange 72. The use of straight through second coolant apertures 74 enables the seal 58 to be manufactured by conventional manufacturing processes, e.g. casting and machining.

The radially extending flange 72 of each seal 58 is secured to the upstream end wall structure 44 such that the seal 58 may move radially and axially with respect to the axis of the corresponding aperture 54 in the upstream end wall structure 44. The radially extending flange 72 of each seal 58 may for example be trapped between the upstream surface of the upstream end wall 41 of the upstream end wall structure 44 and a ring (not shown) which is removably secured to the upstream end wall 41, for example by nuts and bolts or nuts and studs.

A locating ring 76 is provided in each aperture 54 in the upstream end wall structure 44 around the corresponding seal 58 to locate the seal 58 and to locate the aperture in the associated heat shield 43 coaxially with the aperture in the upstream end wall 41. An annular space 78 is defined between each locating ring 76 and the outer surface 62 of the corresponding seal 58. In this example the radially extending flange 72 of each seal 58 is trapped between the upstream surface of the ring which is removably secured to the upstream end wall 41, for example by nuts and bolts or nuts and studs.

The second coolant apertures 74 in the radially extending flange 72 are arranged at a radius $R_3$ from the centre, axis, of the seal 58. The outer surface 62 of the seal 58 has a radius $R_2$ in particular at the first portion 64 adjacent the radially extending flange 72. The aperture 54 in the upstream end wall structure 44 has a radius $R_1$. The second coolant apertures 74 in the radially extending flange 72 are arranged at a radius $R_3$ which is less than or equal to $R_2$+(0.6×(radius $R_1$ of the aperture 54 in the upstream end wall 44−radius $R_2$ of the outer surface 62 of the seal 58)) and at a radius $R_3$ which is more than or equal to $R_2$+(0.3×(radius $R_1$ of the aperture 54 in the upstream end wall 44−radius $R_2$ of the outer surface 62 of the seal 58)). The radius $R_1$ of the aperture 54 in the upstream end wall structure 44 is defined by the locating ring 76. However, it is also possible in some arrangements that a sealing ring is not required and each heat shield 43 has a cylindrical axially upstream extending extension to define the radius $R_1$ of the aperture 54 in the upstream end wall structure 44 or the annular upstream end wall 41 has a plurality of cylindrical axially downstream extending extensions to define the radius $R_1$ of the apertures 54 in the upstream end wall structure 44. The second coolant apertures 74 are located at the radius $R_3$ as defined above so that the second cooling apertures 74 are able to supply coolant into the annular space 78 throughout all operating conditions of the combustion chamber 15 and the gas turbine engine 10, e.g. the second coolant apertures 74 are located at the radius $R_3$ as defined above so that the second cooling apertures 74 are able to supply coolant into the annular space 78 taking into account any relative radial movement between the seal 58 and the associated fuel injector 56 and the axis of the corresponding aperture 54 in the upstream end wall structure 44.

The thickness of the radially extending flange 72 is selected to maximise the second coolant aperture 74 geometry options. The thickness of the radially extending flange is greater than 0.5 mm and less than 8 mm.

Figure 8:
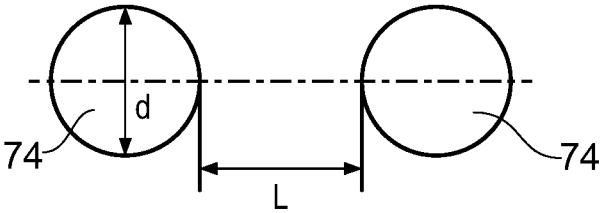
FIG. 8 is an enlarged view of two coolant apertures shown in FIG. 7.

FIG. 8 shows the second coolant apertures 74, the diameters d of the second coolant apertures 74 and the spacing L between the second coolant apertures 74. The quantity of coolant is optimised to maintain the required total coolant flow whilst achieving a spacing, ligament, L between second coolant apertures 74 of d/2<hole-to-hole ligament (L)<4d. The minimum value is required to satisfy mechanical stress requirements whilst the largest value is required to maximise cooling performance and mixing within the annular space 78.

In operation of the turbofan gas turbine engine 10 a fuel and air is supplied through the fuel injectors 56 into the annular combustion chamber 15 and the fuel is burnt in the air. As mentioned previously the seals 58 are subjected to the hot combustion gases in the annular combustion chamber 15 and require cooling to achieve a given metal temperature to meet the working life requirements. Each seal 58 is cooled by supplying coolant, e.g. air, through the first coolant apertures 70 in the first, upstream, portion 64 of the seal 58 and this coolant, air, is directed onto the upstream, cold, surface of the third, downstream, portion 68 to provide impingement cooling of the third, downstream, portion 68 of the seal 58. Each seal 58 is additionally cooled by supplying coolant, air, through the second coolant apertures 74 in the radially extending flange 72 of the seal 58 and this supplies coolant into the annular space 78 between the seal 58 and the locating ring 76. The supply of coolant into the annular space 78 provides additional cooling of the upstream, cold, surface of the third, downstream, portion 68 of the seal 58 and prevents or restricts the flow of hot combustion gases into the annular space 78 and hence reduces the temperature of the third, downstream, portion 68 of the seal 58 and reduces melting and oxidation of the third, downstream, portion 68 of the seal 58. The coolant, air, supplied by the second coolant apertures 74 purges the annular space 78 of hot combustion gases.

The total flow through the first and second coolant apertures 70 and 74 is required to be optimised to ensure the coolant, air, is sufficient to purge the annular space 78 of hot combustion gas and prevent hot combustion gas ingress throughout the flight cycle whilst minimising the interaction with the fuel and air mixture injected by the fuel injector 56.

In thermal modelling using CFD (computational fluid dynamics) of a seal with the first coolant apertures only it was found that hot spots on the seal of up to about 1240° C. were predicted and in thermal modelling using CFD (computational fluid dynamics) of a seal with the first and second coolant apertures it was found that hot spots on the seal of up to about 1160° C. were predicted. This shows that the second coolant apertures have reduced the temperature of the seal.

Figure 9:
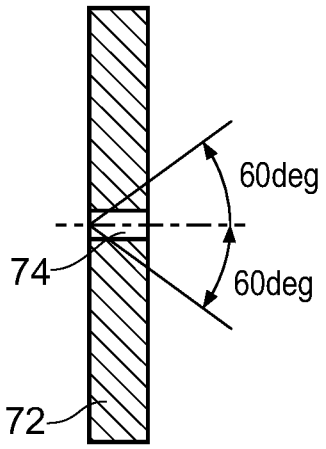
FIG. 9 is an enlarged schematic radial cross-sectional view through a combustion chamber fuel injector seal in the vicinity of a coolant aperture.

However, the axes of the second coolant apertures 74 may be angled radially inwardly or angled radially outwardly, as shown in FIG. 9. The second coolant apertures 74 may be angled radially inwardly at an angle of less than or equal to 60°. The second coolant apertures may be angled radially inwardly at an angle of less than or equal to 45°. The second coolant apertures 74 may be angled radially inwardly at an angle of less than or equal to 30°. The second coolant apertures 74 may be angled radially outwardly at an angle of less than or equal to 60°. The second coolant apertures 74 may be angled radially outwardly at an angle of less than or equal to 45°. The second coolant apertures 74 may be angled radially outwardly at an angle of less than or equal to 30°.

Figure 10:
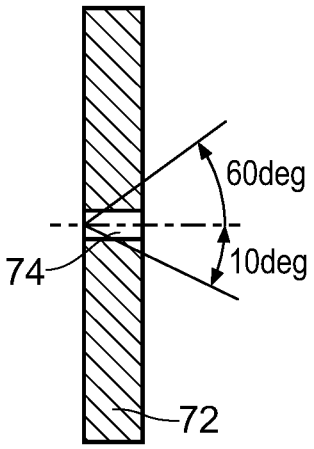
FIG. 10 is an enlarged schematic tangential cross-sectional view through a combustion chamber fuel injector seal in the vicinity of a coolant aperture.

Additionally, the axes of the second coolant apertures 74 may be angled circumferentially, as shown in FIG. 10. The second coolant apertures 74 may be angled circumferentially in the direction of the swirling fuel and air mixture from the associated fuel injector 56. The second coolant apertures 74 may be angled circumferentially at an angle of less than or equal to 60°. The second coolant apertures 74 may be angled circumferentially at an angle of less than or equal to 45°. The second coolant apertures 74 may be angled circumferentially at an angle of less than or equal to 30°. The second coolant apertures 74 may be angled circumferentially in the opposite direction of the swirling fuel and air mixture from the associated fuel injector 56. The second coolant apertures 74 may be angled circumferentially at an angle of less than or equal to 10°.

The seals 58 may be manufactured for example by casting and then drilling, e.g. ECM, EDM or laser drilling, the coolant apertures 70 and 74. The seals 58 may be manufactured by casting using cores to define the coolant apertures 70 and 74 and then removing, e.g. dissolving, the cores. Alternatively, the seals 58 may be manufactured by additive layer manufacturing, e.g. powder bed laser deposition.

Figure 11:
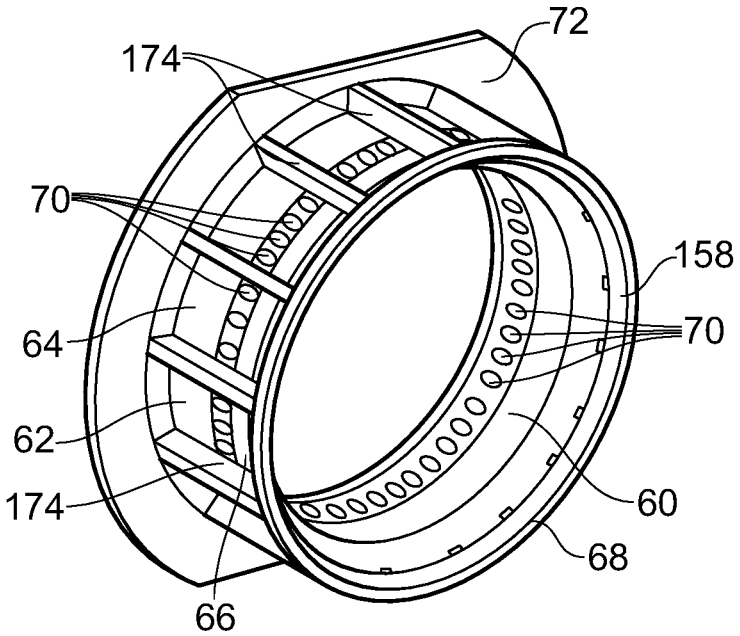
FIG. 11 is a perspective view of another combustion chamber fuel injector seal according to the present disclosure.
Figure 12:
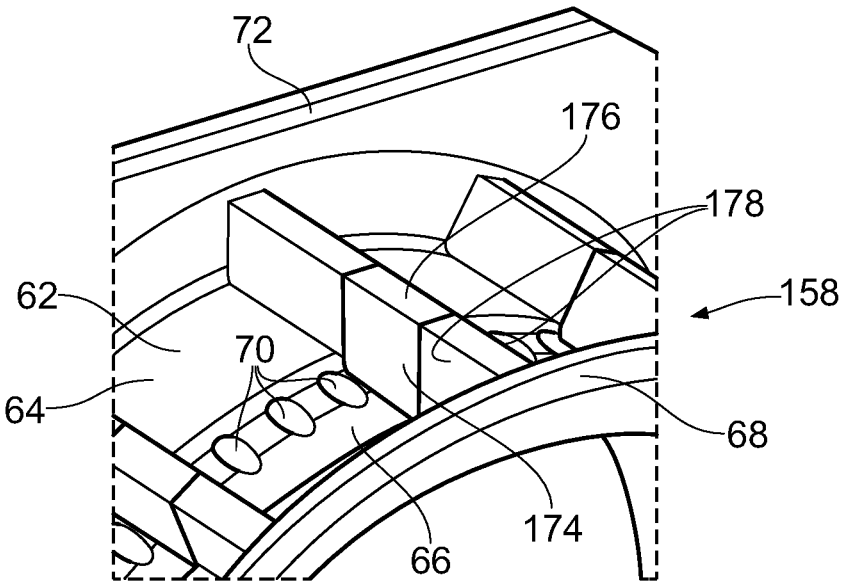
FIG. 12 is an enlarged perspective view of a portion of the combustion chamber fuel injector seal shown in FIG. 11.

FIGS. 11 and 12 show an alternative seal 158 in more detail. Each seal 158 is similar to that shown in FIGS. 3 to 10 and like parts are denoted by like numerals but does not have second coolant apertures in the radially extending flange 72. Each seal 158 has a plurality of thermal conductors 174 extending axially from the radially extending flange 72 to the third, downstream, portion 68 of the seal 158. Each seal 158 has a plurality of circumferentially spaced thermal conductors 174 extending axially from the radially extending flange 72 to the third, downstream, portion 68 of the seal 158. Each thermal conductor 174 extends radially outwardly from the outer surface 62 of the seal 158 and in this example each thermal conductor 174 extends radially outwardly from the outer surface 62 of the seal 158 throughout the full axial distance between the radially extending flange 72 and the third, downstream, portion 68 of the seal 158. Alternatively, each thermal conductor 174 extends radially outwardly from the outer surface 62 of the seal 158 at one or more axially spaced locations between the radially extending flange 72 and the third, downstream, portion 68 of the seal 158.

There may be between 1 and 10 first coolant apertures 70 extending through the seal 158 from the inner surface 60 to the outer surface 62 positioned between each pair of circumferentially spaced thermal conductors 174. The diameter of the first coolant apertures 70 is less than or equal to 3 mm and more than or equal to 0.4 mm.

Each thermal conductor 174 is a rib. Each thermal conductor 174 is rectangular in cross-section. Each thermal conductor 174 has a radially outer surface 176 remote from the outer surface 62 of the seal 158 and side surfaces 178 extending radially from the radially outer surface 176 to the outer surface 62 of the seal 158. The surface area of the radially outer surface 176 of the thermal conductor 174 divided by twice the surface area of the side surfaces 178 of the thermal conductor 174 is less than 1.

The thermal conductors 174 extend radially outwardly to a maximum radius $R_3$ which is less than or equal to $R_2$+(0.6×(radius $R_1$ of the aperture 54 in the upstream end wall 44−radius $R_2$ of the outer surface 62 of the seal 58)). The thermal conductors 174 are designed to ensure that there are no mechanical clashes with surrounding hardware throughout the operation, flight, cycle. The thermal conductors 174 this may involve thinning in the top and bottom of the seal, scalloping of the rib or some form of rib profiling In operation of the turbofan gas turbine engine 10 a fuel and air is supplied through the fuel injectors 56 into the annular combustion chamber 15 and the fuel is burnt in the air. As mentioned previously the seals 58 are subjected to the hot combustion gases in the annular combustion chamber 15 and require cooling to achieve a given metal temperature to meet the working life requirements. Each seal 58 is cooled by supplying coolant, e.g. air, through the first coolant apertures 70 in the first, upstream, portion 64 of the seal 58 and this coolant, air, is directed onto the upstream, cold, surface of the third, downstream, portion 68 to provide impingement cooling of the third, downstream, portion 68 of the seal 58. Each seal 58 is additionally cooled by the thermal conductors 174 which conduct heat from the third, downstream, portion 68 of the seal 158 to the radially extending flange 172.

In thermal modelling using CFD (computational fluid dynamics) of a seal with the first coolant apertures only it was found that hot spots on the seal of up to about 1240° C. were predicted and in thermal modelling using CFD (computational fluid dynamics) of a seal with the first and second coolant apertures it was found that hot spots on the seal of up to about 1140° C. were predicted. This shows that the thermal conductors have reduced the temperature of the seal.

The thermal conductors 174 may be hollow to reduce the weight of the thermal conductors. The thermal conductors 174 may have complex profiles to increase conduction area.

The seals 158 may be manufactured for example by casting and then drilling, e.g. ECM, EDM or laser drilling, the coolant apertures 70 and 74. The seals 158 may be manufactured by casting using cores to define the coolant apertures 70 and 74 and then removing, e.g. dissolving, the cores. Alternatively, the seals 158 may be manufactured by additive layer manufacturing, e.g. powder bed laser deposition.

Figure 13:
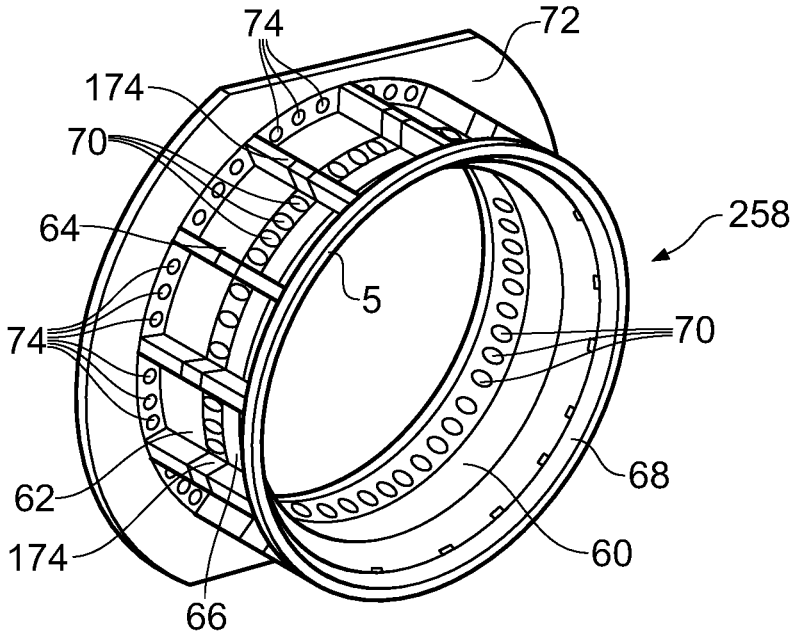
FIG. 13 is a perspective view of another combustion chamber fuel injector seal according to the present disclosure.

FIG. 13 shows another seal 258 in more detail. Each seal 258 is similar to that shown in FIGS. 3 to 10 and like parts are denoted by like numerals and has the second coolant apertures 72 in the radially extending flange 72. Each seal 258 also has a plurality of thermal conductors 174 extending axially from the radially extending flange 72 to the third, downstream, portion 68 of the seal 258. Each seal 258 has a plurality of circumferentially spaced thermal conductors 174 extending axially from the radially extending flange 72 to the third, downstream, portion 68 of the seal 258. Each thermal conductor 174 extends radially outwardly from the outer surface 62 of the seal 258 and in this example each thermal conductor 174 extends radially outwardly from the outer surface 62 of the seal 258 throughout the full axial distance between the radially extending flange 72 and the third, downstream, portion 68 of the seal 258. Alternatively, each thermal conductor 174 extends radially outwardly from the outer surface 62 of the seal 258 at one or more axially spaced locations between the radially extending flange 72 and the third, downstream, portion 68 of the seal 258. The total flow through the first and second coolant apertures 70 and 74 is required to be optimised to ensure the coolant, air, is sufficient to purge the annular space 78 of hot combustion gas and prevent hot combustion gas ingress throughout the flight cycle whilst minimising the interaction with the fuel and air mixture injected by the fuel injector 56.

There may be between 1 and 10 second coolant apertures 74 extending axially through the radially extending flange 72 positioned between each pair of circumferentially spaced thermal conductors 174. The diameter of the second coolant apertures 74 is less than or equal to 3 mm and more than or equal to 0.4 mm.

There may be between 1 and 10 first coolant apertures 70 extending through the seal 258 from the inner surface 60 to the outer surface 62 positioned between each pair of circumferentially spaced thermal conductors 174. The diameter of the first coolant apertures 70 is less than or equal to 3 mm and more than or equal to 0.4 mm.

The seals 258 may be manufactured for example by casting and then drilling, e.g. ECM, EDM or laser drilling, the coolant apertures 70 and 74. The seals 258 may be manufactured by casting using cores to define the coolant apertures 70 and 74 and then removing, e.g. dissolving, the cores. Alternatively, the seals 258 may be manufactured by additive layer manufacturing, e.g. powder bed laser deposition.

Figure 14:
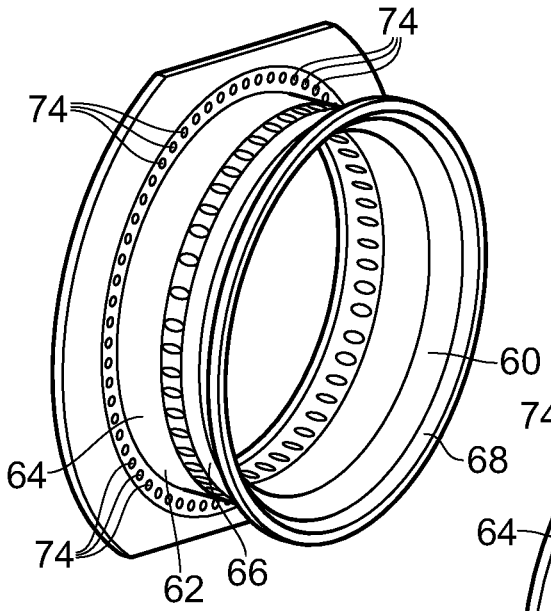
FIG. 14 is a perspective view of a further combustion chamber fuel injector seal according to the present disclosure.

FIG. 14 shows another seal 358 in more detail. Each seal 358 is similar to that shown in FIGS. 3 to 10 and like parts are denoted by like numerals but does not have the first coolant apertures in the first portion 64 of the seal 358.

The total flow through the second coolant apertures 74 is required to be optimised to ensure the coolant, air, is sufficient to purge the annular space 78 of hot combustion gas and prevent hot combustion gas ingress throughout the flight cycle whilst minimising the interaction with the fuel and air mixture injected by the fuel injector 56.

Figure 15:
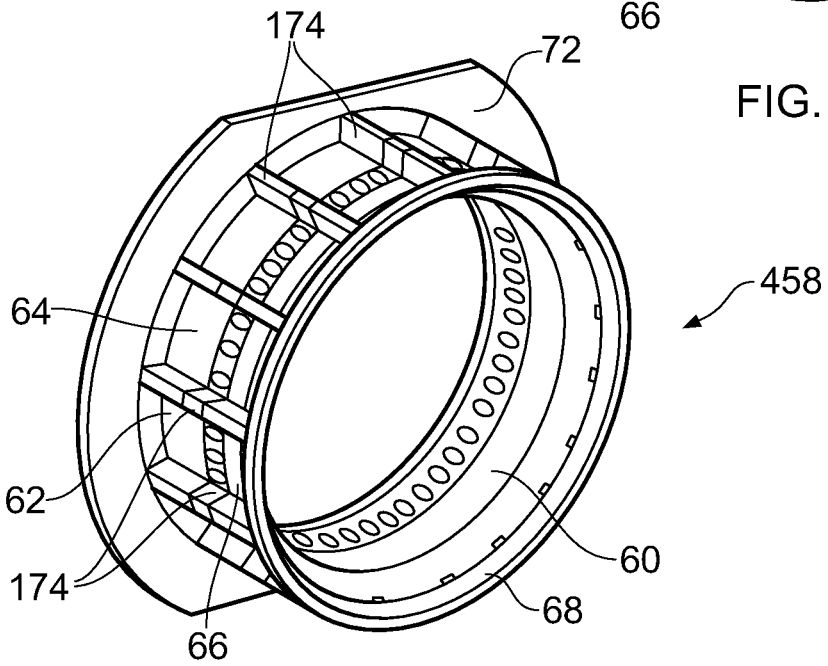
FIG. 15 is a perspective view of an additional combustion chamber fuel injector seal according to the present disclosure.

FIG. 15 shows another seal 458 in more detail. Each seal 458 is similar to that shown in FIGS. 11 and 12 and like parts are denoted by like numerals but does not have the first coolant apertures in the first portion 64 of the seal 458.

Figure 16:
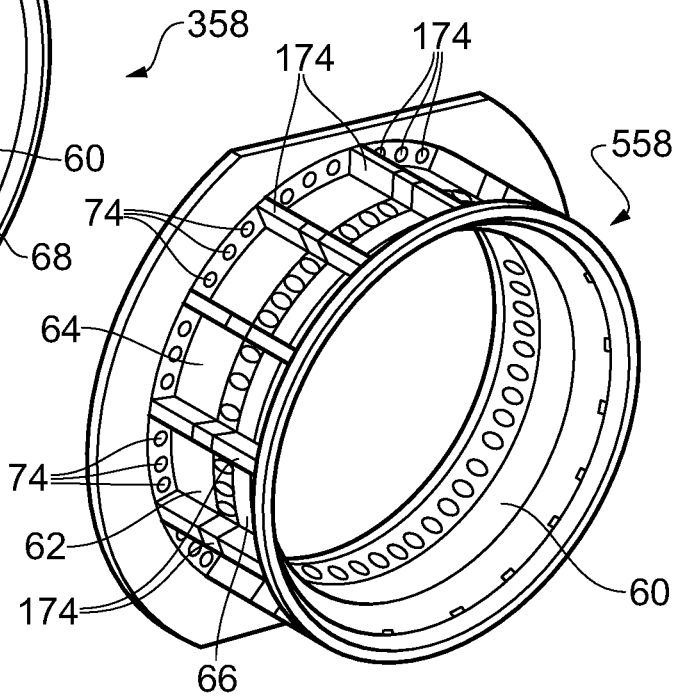
FIG. 16 is a perspective view of a further combustion chamber fuel injector seal according to the present disclosure.

FIG. 16 shows another seal 558 in more detail. Each seal 558 is similar to that shown in FIG. 13 and like parts are denoted by like numerals but does not have the first coolant apertures in the first portion of the seal 558.

The total flow through the second coolant apertures 74 is required to be optimised to ensure the coolant, air, is sufficient to purge the annular space 78 of hot combustion gas and prevent hot combustion gas ingress throughout the flight cycle whilst minimising the interaction with the fuel and air mixture injected by the fuel injector 56.

The seals 358, 458 and 558 may be manufactured for example by casting and then drilling, e.g. ECM, EDM or laser drilling, the coolant apertures 70. The seals 358, 458 and 558 may be manufactured by casting using cores to define the coolant apertures 70 and then removing, e.g. dissolving, the cores. Alternatively, the seals 358, 458 and 558 may be manufactured by additive layer manufacturing, e.g. powder bed laser deposition.

The shape of the second coolant apertures may be optimised to exploit additive layer manufacture. The shape of the second cooling aperture may be comprise in flow series a metering section having a constant cross-sectional area and a diffusing section adjacent the outlet to produce a diffusing flow of coolant to enhance mixing within the annular space between the seal and the locating ring improving cooling performance. The diffusing section may have a frustoconical shape, a bell mouth shape or other suitable diffusing shape.

The axes of the second cooling apertures and/or the axes of the first cooling apertures direction may be orientated to establish a swirling flow of coolant within the annular space between the seal and the locating ring to enhance convective cooling of the seal whilst minimising the interaction of coolant flow with the swirling fuel and air mixture from the fuel injector.

It is to be noted that the downstream end, e.g. the third, downstream, portion 68 of each of the seals 58, 158, 258, 358 and 458 is positioned axially downstream of the upstream end wall structure 44 and the upstream end, e.g. the first upstream, portion of each of the seals 58, 158, 258, 358 and 458 is positioned axially upstream of the upstream end wall structure 44. The radially extending flange 72 of each of the seals 58, 158, 258, 358 and 458 is positioned axially upstream of the upstream end wall structure 44. The downstream end, e.g. the third, downstream, portion 68 each of the seals 58, 158, 258, 358 and 458 is positioned axially downstream of the upstream end wall 41. The downstream end, e.g. the third, downstream, portion 68 each of the seals 58, 158, 258, 358 and 458 is positioned axially downstream of the heat shield 43. It is also to be noted that because each of the seals 58, 158, 258, 358 and 458 is located a corresponding one of the apertures 54 in the upstream end wall structure 44 an annular space 78 is formed between the outer surface 62 of each of the seals 58, 158, 258, 358 and 458 and the upstream end wall structure 44.

Figure 17:
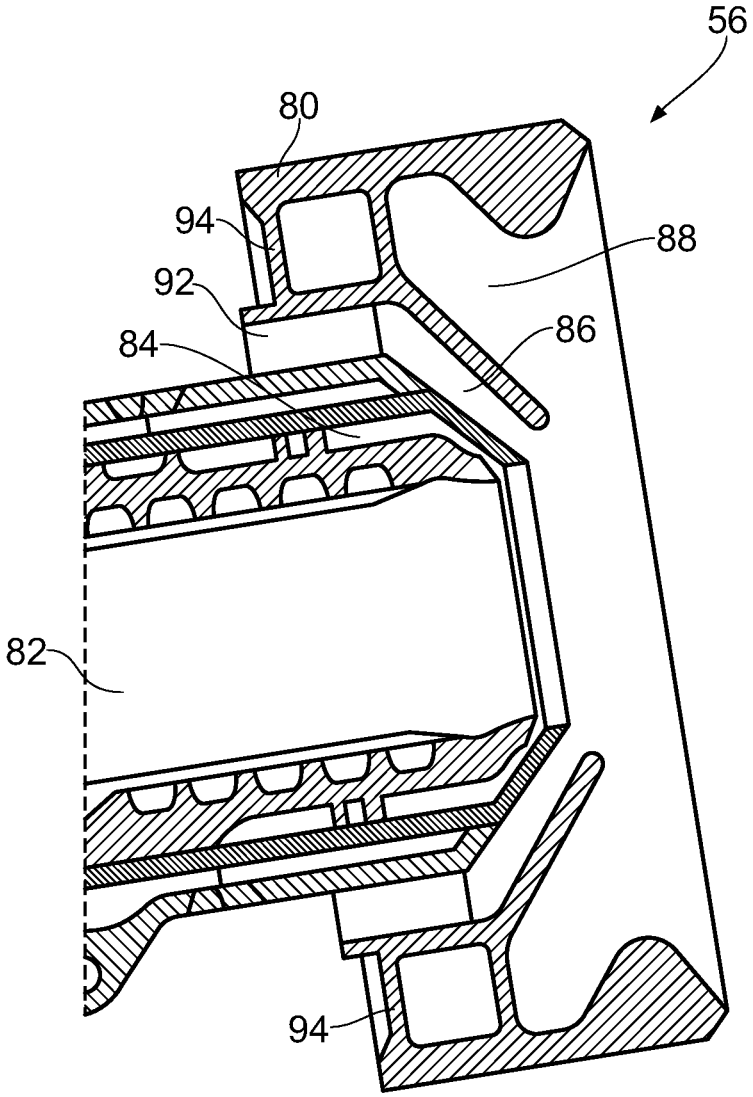
FIG. 17 is a cross-sectional view through a fuel injector shown in FIG. 2.

FIG. 17 shows a longitudinal cross-section through a rich burn fuel injector 56. The rich burn fuel injector 56 comprises a fuel feed arm and a fuel injector head 80. The fuel injector head 80 comprises an airblast fuel injector. The airblast fuel injector has, in order from radially inner to outer, a coaxial arrangement of an inner swirler air passage 82, a fuel passage 84, an intermediate air swirler passage 86 and an outer air swirler passage 88. The swirling air passing through the passages 82, 86, 88 of the fuel injector head 80 is high pressure and high velocity air derived from the high pressure compressor 14. Each swirler passage 82, 86, 88 has a respective swirler 92, 94 which swirls the air flow through that passage.

Figure 18:
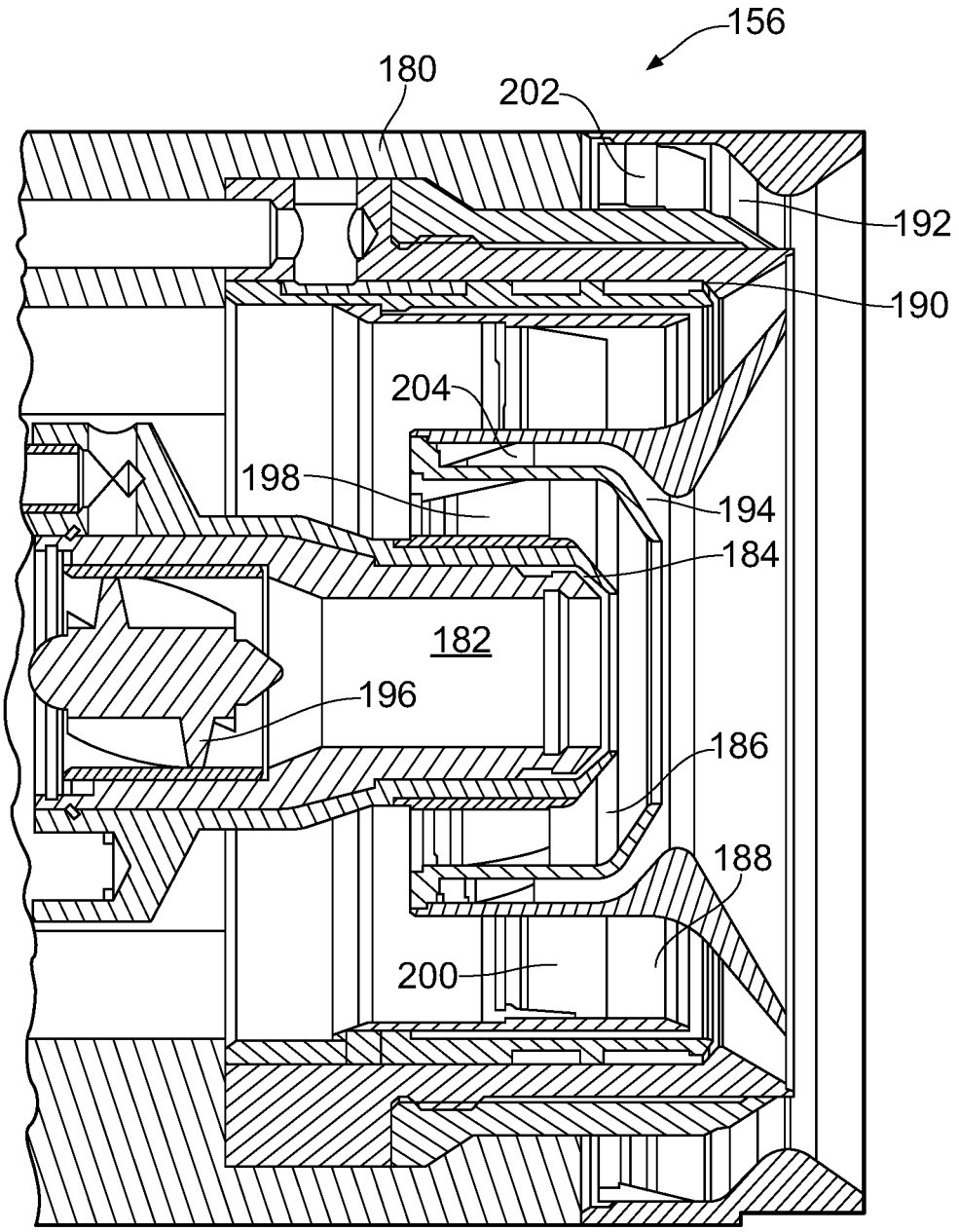
FIG. 18 is a cross-sectional view through an alternative fuel injector shown in FIG. 2.

FIG. 18 shows a longitudinal cross-section through a lean burn fuel injector 156. The lean burn fuel injector 156 comprises a fuel feed arm and a fuel injector head 180. The fuel injector head 180 has a coaxial arrangement of an inner pilot airblast fuel injector and an outer mains airblast fuel injector. The pilot airblast fuel injector has, in order from radially inner to outer, a coaxial arrangement of a pilot inner swirler air passage 182, a pilot fuel passage 184, and a pilot outer air swirler passage 186. The mains airblast fuel injector has, in order from radially inner to outer, a coaxial arrangement of a mains inner swirler air passage 188, a mains fuel passage 190, and a mains outer air swirler passage 192. An intermediate air swirler passage 194 is sandwiched between the outer air swirler passage 186 of the pilot airblast fuel injector and the inner swirler air passage 188 of the mains airblast fuel injector. The swirling air passing through the passages 182, 186, 188, 192, 194 of the fuel injector head 180 is high pressure and high velocity air derived from the high pressure compressor 14. Each swirler passage 182, 186, 188, 192, 194 has a respective swirler 196, 198, 200, 202, 204 which swirls the air flow through that passage.

Each of the fuel injector heads 80, 180 may have a portion which has part spherical surface so to abut and seal against the inner surface of the second portion 62 of the associated seal 58.

Although the present disclosure has been described with reference to an annular combustion chamber it is equally applicable to a tubular combustion chamber comprising an upstream end wall structure and an annular wall structure and the upstream end wall structure has a single aperture with a fuel injector and a seal or to a can annular combustion chamber arrangement comprising a plurality of circumferentially spaced tubular combustion chambers each comprising an upstream end wall structure and an annular wall structure and the upstream end wall of each tubular combustion chamber has a single aperture with a fuel injector and a seal. The upstream wall structure comprises an upstream end wall and a heat shield and the annular wall structure comprises an outer annular wall and an inner annular wall spaced radially from and arranged radially within the outer annular wall and the outer annular wall supports the inner annular wall. The inner annular wall comprises a plurality of rows of combustion chamber tiles secured to the outer annular wall by threaded studs, washers and nuts. The heat shield is secured onto the upstream end wall by threaded studs, washers and nuts.

Although the description has referred to one of the annular wall comprising a plurality of rows of combustion chamber tiles it may be possible for that wall to comprise a single row of combustion chamber tiles which extend substantially the full length of the combustion chamber.

Although the description has referred to annular wall structures comprising two radially spaced walls it may be possible for the annular wall structure to simply comprise a single annular wall.

The combustion chamber may be a gas turbine engine combustion chamber.

The gas turbine engine may be an industrial gas turbine engine, an automotive gas turbine engine, a marine gas turbine engine or an aero gas turbine engine. The aero gas turbine engine may be a turbofan gas turbine engine, a turbojet gas turbine engine, a turbo-propeller gas turbine engine or a turbo-shaft gas turbine engine.

The advantage of the present disclosure is that the temperature of the third portion of the seal is reduced sufficiently to prevent melting and melting back of the third portion of the seal. A further advantage is that molten material is not released from the seal and hence is not deposited onto the annular wall of the combustion chamber, e.g. combustion chamber tiles, and other components of the gas turbine engine, e.g. turbine blades and turbine vanes, downstream of the combustion chamber. Furthermore, there isn't a change in local mixing and stoichiometry in the combustion chamber to increase the increase of temperature of the surrounding combustion chamber components.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A combustion chamber comprising an upstream end wall, at least one annular wall, at least one fuel injector and at least one seal, the at least one annular wall being secured to the upstream end wall, the upstream end wall having at least one aperture, each fuel injector being arranged in a corresponding one of the apertures in the upstream end wall, each seal being arranged in a corresponding one of the apertures in the upstream end wall and around the corresponding one of the fuel injectors, each seal having an inner surface facing the corresponding one of the fuel injectors and an outer surface facing away from the corresponding one of the fuel injectors, each seal abutting the corresponding one of the fuel injectors, the downstream end of each seal increasing in diameter in a downstream direction, the upstream end of each seal having a radially extending flange extending outward of the outer surface, the downstream end of each seal being positioned axially downstream of the upstream end wall, each seal being located in the corresponding one of the apertures in the upstream end wall such that an annular space is formed between the outer surface of the seal and the upstream end wall, each seal having a plurality of thermal conductors extending axially from the radially extending flange to the downstream end of the seal, and wherein each thermal conductor extends radially outwardly from the outer surface of the seal throughout the full axial distance between the radially extending flange and the downstream end of the seal.

2. The combustion chamber as claimed in claim 1, each seal having a plurality of coolant apertures extending axially through the radially extending flange, wherein each seal has at least one circumferentially spaced row of the apertures extending axially through the radially extending flange.

3. The combustion chamber as claimed in claim 1, each seal having a plurality of coolant apertures extending axially through the radially extending flange, wherein each seal has a plurality of circumferentially spaced rows of the apertures extending axially through the radially extending flange.

4. The combustion chamber as claimed in claim 1, each seal having a plurality of coolant apertures extending axially through the radially extending flange, wherein the diameter of the coolant apertures is less than or equal to 3 mm and more than or equal to 0.4 mm.

5. The combustion chamber as claimed in claim 1, each seal having a plurality of coolant apertures extending axially through the radially extending flange, wherein the axes of the coolant apertures are angled radially inwardly or angled radially outwardly.

6. The combustion chamber as claimed in claim 5 wherein the coolant apertures are angled radially inwardly at an angle of less than or equal to 60°.

7. The combustion chamber as claimed in claim 5 wherein the coolant apertures are angled radially outwardly at an angle of less than or equal to 60°.

8. The combustion chamber as claimed in claim 1, each seal having a plurality of coolant apertures extending axially through the radially extending flange, wherein the coolant apertures extend purely perpendicularly through the radially extending flange.

9. The combustion chamber as claimed in claim 1, each seal having a plurality of coolant apertures extending axially through the radially extending flange, wherein the axes of the coolant apertures are angled circumferentially.

10. The combustion chamber as claimed in claim 9 wherein the coolant apertures are angled circumferentially in a direction of swirling fuel and air mixture from the fuel injector.

11. The combustion chamber as claimed in claim 10 wherein the coolant apertures are angled circumferentially at an angle of less than or equal to 60°.

12. The combustion chamber as claimed in claim 9 wherein the coolant apertures are angled circumferentially in an opposite direction of swirling fuel and air mixture from the fuel injector.

13. The combustion chamber as claimed in claim 12 wherein the coolant apertures are angled circumferentially at an angle of less than or equal to 10°.

14. The combustion chamber as claimed in claim 1, each seal having a plurality of coolant apertures extending axially through the radially extending flange, wherein the coolant apertures in the radially extending flange are arranged at a radius less than or equal to the radius of the outer surface of the seal+(0.6×(radius of the aperture in the upstream end wall—radius of the outer surface of the seal)) and at a radius more than or equal to the radius of the outer surface of the seal+(0.3×(radius of the aperture in the upstream end wall—radius of the outer surface of the seal)).

15. The combustion chamber as claimed in claim 1 wherein the thermal conductors are hollow.

16. The combustion chamber as claimed in claim 1 wherein each thermal conductor has a radially outer surface remote from the outer surface of the seal and side surfaces extending radially from the radially outer surface to the outer surface of the seal.

17. The combustion chamber as claimed in claim 16 wherein the surface area of the radially outer surface of the thermal conductor divided by twice the surface area of the side surfaces of the thermal conductor is less than 1.

18. The combustion chamber as claimed in claim 1, each seal having a plurality of coolant apertures extending axially through the radially extending flange, wherein there are between 1 and 10 coolant apertures extending axially through the radially extending flange positioned between each pair of circumferentially spaced thermal conductors.

19. The combustion chamber as claimed in claim 18 wherein the diameter of the coolant apertures is less than or equal to 3 mm and more than or equal to 0.4 mm.

20. The combustion chamber as claimed in claim 1, each seal having a plurality of coolant apertures extending axially through the radially extending flange, wherein there are between 1 and 10 coolant apertures extending through the seal from the inner surface to the outer surface positioned between each pair of circumferentially spaced thermal conductors.

21. The combustion chamber as claimed in claim 20, each seal having a plurality of coolant apertures extending axially through the radially extending flange, wherein the diameter of the coolant apertures is less than or equal to 3 mm and more than or equal to 0.4 mm.

22. The combustion chamber as claimed in claim 1 wherein each seal has a plurality of coolant apertures extending axially through the radially extending flange and each seal has a second plurality of coolant apertures extending there-through, each of the second plurality of coolant aperture has an inlet in the inner surface and an outlet in the outer surface of the seal, the second plurality of coolant apertures being arranged upstream of the downstream end of the seal, the second plurality of coolant apertures extending there-through with axial and radial components, the outlet of each of the second plurality of coolant aperture being axially spaced in a downstream direction from its inlet, the outlet of each of the second plurality of coolant aperture being radially spaced from its inlet.

23. A combustion chamber comprising an upstream end wall, at least one annular wall, at least one fuel injector and at least one seal, the at least one annular wall being secured to the upstream end wall, the upstream end wall having at least one aperture, each fuel injector being arranged in a corresponding one of the apertures in the upstream end wall, each seal being arranged in a corresponding one of the apertures in the upstream end wall and around the corresponding one of the fuel injectors, each seal having an inner surface facing the corresponding one of the fuel injectors and an outer surface facing away from the corresponding one of the fuel injectors, each seal abutting the corresponding one of the fuel injectors, the downstream end of each seal increasing in diameter in a downstream direction, the upstream end of each seal having a radially extending flange extending outward of the outer surface, each seal having a plurality of thermal conductors extending axially from the radially extending flange to the downstream end of the seal, and wherein each thermal conductor extends radially outwardly from the outer surface of the seal throughout the full axial distance between the radially extending flange and the downstream end of the seal.

* * * * *